US011732521B2

(12) United States Patent
Reddmann

(10) Patent No.: US 11,732,521 B2
(45) Date of Patent: Aug. 22, 2023

(54) OPENING APPARATUS FOR A MOTOR VEHICLE DOOR

(71) Applicant: Kiekert AG, Heiligenhaus (DE)

(72) Inventor: Uwe Reddmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 125 days.

(21) Appl. No.: 16/757,068

(22) PCT Filed: Oct. 10, 2018

(86) PCT No.: PCT/DE2018/100834
§ 371 (c)(1),
(2) Date: May 1, 2020

(87) PCT Pub. No.: WO2019/076398
PCT Pub. Date: Apr. 25, 2019

(65) Prior Publication Data

US 2020/0270930 A1 Aug. 27, 2020

(30) Foreign Application Priority Data

Oct. 18, 2017 (DE) ..... 10 2017 124 282.1

(51) Int. Cl.
*E05F 15/00* (2015.01)
*E05F 15/619* (2015.01)

(52) U.S. Cl.
CPC ..... *E05F 15/619* (2015.01); *E05Y 2900/531* (2013.01)

(58) Field of Classification Search
CPC ..... E05F 15/619; E05F 15/60; E05F 15/40
See application file for complete search history.

(56) References Cited

U.S. PATENT DOCUMENTS

| | | | | |
|---|---|---|---|---|
| 10,190,344 | B2 | 1/2019 | Reddmann | |
| 10,612,288 | B2 | 4/2020 | Rietdijk | |
| 2004/0111970 | A1* | 6/2004 | Fenelon | E05F 11/525 49/349 |
| 2009/0007707 | A1* | 1/2009 | Schumacher | E05B 81/25 74/30 |

(Continued)

FOREIGN PATENT DOCUMENTS

| | | | |
|---|---|---|---|
| CA | 2524114 | A1 | 4/2006 |
| CN | 203050349 | U | 7/2013 |

(Continued)

OTHER PUBLICATIONS

Translation of International Search Report dated Jan. 22, 2019 for PCT/DE2018/100834.

(Continued)

*Primary Examiner* — Janet M Wilkens
*Assistant Examiner* — Daniel Alvarez
(74) *Attorney, Agent, or Firm* — Renner, Otto, Boisselle & Sklar, LLP

(57) ABSTRACT

An opening apparatus for a motor vehicle door, having an electric drive and an actuating means, wherein the actuating means can be adjusted by means of the drive and wherein the motor vehicle door can be opened by means of the actuating means and at least one sensor for detecting the actuating movement (S), wherein continuous detection of the actuating movement (S) can be rendered possible by means of the sensor.

19 Claims, 1 Drawing Sheet

(56) References Cited

U.S. PATENT DOCUMENTS

| | | | | |
|---|---|---|---|---|
| 2017/0029231 | A1 | 10/2017 | Podkopayev | |
| 2017/0292310 | A1* | 10/2017 | Podkopayev | E05C 17/006 |
| 2019/0078361 | A1* | 3/2019 | Worden | E05C 17/203 |
| 2019/0112858 | A1* | 4/2019 | Partsch | E05F 5/025 |

FOREIGN PATENT DOCUMENTS

| | | | | | |
|---|---|---|---|---|---|
| DE | 19642064 | A1 | * | 4/1998 | E05F 15/619 |
| DE | 19835994 | A1 | | 2/2000 | |
| DE | 10114938 | A1 | * | 10/2001 | B60J 5/106 |
| DE | 10124783 | A1 | | 11/2002 | |
| DE | 102015103830 | A1 | | 9/2016 | |
| DE | 102015215631 | A1 | | 2/2017 | |
| DE | 102016105760 | A1 | | 10/2017 | |
| JP | 2000356069 | A | * | 12/2000 | E05F 15/63 |
| JP | 2001277853 | A | | 10/2001 | |
| JP | 2004027751 | A | | 1/2004 | |

OTHER PUBLICATIONS

Second Chinese Office Action dated Jan. 26, 2022, for corresponding Chinese Patent Application No. 2018800747425.

* cited by examiner

OPENING APPARATUS FOR A MOTOR VEHICLE DOOR

FIELD OF INVENTION

The invention relates to an opening apparatus for a motor vehicle door, having an electric drive and an actuating means, the actuating means being able to be adjusted by means of the drive and the motor vehicle door being able to be opened by means of the actuating means, and at least one sensor for detecting the actuating movement.

BACKGROUND OF INVENTION

Modern motor vehicles are ever more frequently being provided with convenience functions. For example, to make it simpler to get in a motor vehicle and to boost both the aesthetics and the aerodynamic shape, motor vehicles are fitted out without an external door handle, for instance. However, it is also conceivable for an external door handle to be provided but for it to merely relay a switching signal to the motor vehicle door latch for the purpose of opening. To make the process of getting in a vehicle simpler and automated, and to make it possible to get in vehicles that have no external door handle, "opening apparatuses" or door adjusters or door openers are used.

In a known door adjuster or a known, accordingly configured opening apparatus for a motor vehicle door, as known from DE 198 35 994 A1, a spindle drive is used. The spindle drive or ejector device is activated by unlocking an associated door latch on a flap, in particular a boot. By means of the ejector device, the flap is pivoted and a gap formed, to which a first opening position is assigned. As a result, a handle can pivot into the gap and protrude out beyond a flap outer contour. The consequence of this is a relatively complex design.

DE 10 2016 105 760 A1 discloses an opening apparatus for a motor vehicle door, comprising a base plate, further comprising a drive member mounted on the base plate, and a drive, a first sensor being provided, which is assigned to the drive member and distinguishes at least between an opening process and a manual opening process. In the process, the opening apparatus comprises a drive, which can be driven by means of a sensor and a control unit. A flexible connection means then makes it possible to pivot a transmission level, which in turn makes an opening movement possible by means of a drive lever and a drive slide. To make it possible to move or open the door, the drive slide travels in a linear manner and, for example, out of an opening in a vehicle body, so that an unlocked and unlatched door can be opened at least in some regions. The end position of the drive slide can be detected by means of a second, immovable sensor, so that the drive can be switched off again.

DE 10 2015 103 830 A1 discloses a door opener in the form of a driven actuating rod. An actuating rod, which can be designed as a threaded rod, interacts with a stop arranged immovably in the motor vehicle door. By means of the actuator and the actuating rod, therefore, a force can be exerted on the stop, so that the door can be opened once the motor vehicle latch has been unlatched.

The apparatuses known from the state of the art for opening a motor vehicle door once a motor vehicle latch has been unlatched make it possible for the door to be opened at least in some regions, so that an operator of the motor vehicle is able to open the door through a gap. The known opening apparatuses have proven themselves in principle, but some of them provide complex structural solutions, which moreover make continuous monitoring of the actuating movement possible only with considerable effort. This is where the invention starts from.

SUMMARY OF INVENTION

The object of the invention is to provide an improved opening apparatus for a motor vehicle. In addition, the object of the invention is to provide an opening apparatus that makes it possible to open the motor vehicle door reliably and to detect the actuating movement with the fewest possible means. Furthermore, the object of the invention is to provide a structurally simple and cost-effective solution.

The object is achieved by the features of independent claim 1. The dependent claims set out advantageous embodiments of the invention. It should be noted that the exemplary embodiments described below are not limiting, but rather any possible variations of the features described in the description and the dependent claims are possible.

In accordance with claim 1, the object of the invention is achieved by providing an opening apparatus for a motor vehicle, having an electric drive and an actuating means, the actuating means being able to be adjusted by means of the drive and the motor vehicle door being able to be opened by means of the actuating means, and at least one sensor for detecting the actuating movement, continuous detection of the actuating movement being able to be made possible by means of the sensor. Due to the opening apparatus design according to the invention, it is now possible to enable reliable and energy-efficient opening of a motor vehicle door or flap.

Owing to the continuous monitoring of the actuating member by means of a sensor, the actuating movement of the actuating means can be stopped at any time if the door is opened by manual intervention, for example. The continuous detection thus makes it possible to implement an adapted actuating movement to the operating behaviour of the motor vehicle driver. If, for instance, the door is gripped immediately after being opened by means of the opening apparatus and is manually opened, this can be detected by means of the sensor, thereby making it possible to stop the drive of the opening apparatus so that an adapted opening can be made possible with the lowest possible energy consumption. In addition, the opening device can also be moved back immediately after the door is gripped by the operator, so that the operator can get in the vehicle unhindered. This prevents or minimises any hindrance to the operator caused by the opening apparatus.

The opening apparatus relates to motor vehicle doors, but within the context of the invention it can also be used in boots, flaps, covers or bonnets. In other words, it can be used anywhere where movably arranged parts on motor vehicles are held in a closed position and are brought into an opened position in order to be opened. The opened position then allows the operator to reach into a gap generated by the opening apparatus so that manual opening can be made possible.

In this case, an electric drive enables movement of the actuating means. Electric motors are preferably used as the electric drives. By means of the electric motor, it is then possible to move the actuating means, and specifically such that the door can be opened by the driven actuating means. In the process, the actuating means moves relative to the body and exerts a pressure force on the motor vehicle door so that the unlocked and unlatched door can be moved.

According to the invention, a motor vehicle closure system having a catch and at least one pawl interacts with the opening apparatus, the locking mechanism consisting of the catch and at least one pawl being able to be unlatched electrically. In particular in electrically unlatchable closure systems, the operator of the motor vehicle requires merely an electrical pulse in order to transfer the closure system into an unlatched, i.e. opened, position. The closure system is then in an opened state so that the door or flap can be moved. The electrical opening pulse for the closure system can be generated by means of a sensor, a key or, for example, by means of a sensitive means, such as a contact sensor or a door handle comprising an integrated sensor.

Once the motor vehicle door is in the unlatched state, it can be freely pivoted in the hinges. Optionally, the door also has a door rebound strap, which can hold the door in a plurality of opening positions. Once the door is unlatched, it can then be moved by means of the opening apparatus, the movement of the motor vehicle door being able to be sensed according to the invention. The entire opening process is thus detected, and in particular it is detected continuously so that a movement of the door can be detected regardless of the opening means or the opening apparatus. Once a door has been moved out manually by means of the movement of the opening apparatus, it disconnects the sensor detection so that the electric drive can be de-energized or the polarity of the electric drive can be reversed so that the actuating means can be moved back into its initial position.

In an alternative embodiment of the invention, the sensor can be integrated in the actuating means. Arranging the sensor as an integrated means in the actuating means equally provides several advantages. Firstly, a structurally advantageous and compact arrangement of the sensor can be made possible, and secondly a signal can be generated directly from the movement of the actuating means. In this regard, both sensitive and mechanical switching means, such as microswitches or proximity sensors, can be used as the sensor. The switching means can interact with the door directly, or can be switchable indirectly. The switching means is preferably activated upon movement of the actuating means, or generates a switching signal. In the process, by means of the movement of the actuating means, the switching means is switched or activated in the direction of the door or flap so that a switching signal can be relayed to a control unit. The control unit is used to render the signal of the unlatching of the locking mechanism of the closure device detectable so that the electric drive of the opening apparatus can be triggered and the actuating means displaces the door in the direction of the opening movement. Preferably, the actuating means performs a linear movement in the process.

If the actuating means is constructed in at least two parts and has a drive region and a sliding member, this results in a further alternative embodiment of the invention. A multi-part design of the actuating means makes it possible for the actuating means to be adaptable to the different requirements in the interaction between the drive, the bearings and the pressure region. Firstly, the actuating means must be securely guidable, with low-noise and wear-free guidance being required. In particular, accommodating the actuating means in the opening apparatus in a low-noise manner increases the quality and sense of convenience for the operator. Advantageously, the drive region can consist, for example, of a metal material that ensures a long service life and, for example, makes a sliding bearing or roller bearing possible.

In addition, the drive region must be designed such that a fatigue-endurable connection and transmission of the electric drive to the actuating means can be made possible. Preferably, the electric drive has, for example, a worm wheel which can be engaged with the actuating means, the actuating means being able to have, for example, teeth that are complementary to the worm wheel.

In addition, the actuating means must be able to be engaged with the door or at least one region of the door so that movement or pivoting of the door by means of the opening device can be made possible. Particularly in the contact region between the actuating means and the door, it may be advantageous to arrange a sliding member that can be engaged with the door, for example in a spring-biased manner. Preferably, the sliding member can be made of plastics material so that, firstly, no or only slight contact noises can be generated, and secondly, damped movement can be made possible by means of the actuating means. In addition to the drive region and the sliding member, it is of course also conceivable, for example, for components that are required for mounting the actuating means to be integrated in the actuating means or arranged on the actuating means.

To integrate the sensor in the actuating means, sealing covers can also be arranged on the actuating means.

In a further alternative embodiment of the invention, the sliding member can be movably accommodated in the actuating means. Preferably, the sliding member is displaceably mounted in the drive region. For this purpose, the drive region and/or the sliding member can have guide members; additionally, a spring member, such as a compression spring, can position the sliding member relative to the drive region. Preferably, the sliding member is held in the actuating means in a spring-biased manner such that the sliding member is pushed out of the actuating means or the drive region by means of the pressure of the spring. When the actuating means is in the non-operated state, the sliding member is thus in the state protruding out of the drive region and abuts, for example, a stop in the drive region.

If the electric drive is now operated, the actuating means is moved out of, for example, a B-pillar of the body, and the sliding member is engaged with the motor vehicle door. When the motor vehicle door is in the closed state, the sliding member preferably abuts the motor vehicle door so that the door can be opened while generating as little noise as possible. Preferably, the sliding member has a damping means on the side opposite the motor vehicle door. The damping means can, for example, consist of a resilient plastics material. Preferably, the sliding member consists of plastics material and can, for example, be constructed as a two-component part. On the one hand, a rigid plastics material enables secure mounting and guidance in the actuating means, and on the other hand, a resilient, soft plastics material enables advantageous contact with the motor vehicle door.

In an alternative embodiment, the sensor can be operated by means of the sliding member. If the sensor can be indirectly activated by the motor vehicle door, in which case the sliding member can be displaced when actuated by the motor vehicle door or by the electric drive, conclusions can be drawn directly on operation of the actuating means. When the actuating means is in the non-operated state, the sliding member abuts the motor vehicle door in a spring-biased manner.

If the actuating means is now activated by means of the drive and moved out of, for example, a B-pillar or C-pillar of the motor vehicle, the sliding member displaces relative to the drive region of the actuating means, in which case, due to the relative movement of the sliding member preferably such that the sliding member is displaced into the drive region, the sensor is arranged such that the sliding member activates the sensor. In other words, if the actuating means is directly driven by means of the electric drive, the first movement of the actuating means results in a relative movement between the sliding member and the drive region. The sensor is thus operated by the actuating means itself. Preferably, for example a microswitch can be integrated in the actuating means, and said microswitch can then be operated by the relative movement of the sliding member. Of course, it is also conceivable for the switching means to be fastened to the sliding member, in which case a touch-sensitive sensor can be activated, for example, by a relative movement between the sliding member and the drive region.

If the actuating means is designed as a rack at least in some regions, preferably in the drive region, this results in a further alternative embodiment of the invention. In this case, a rack provides the advantage of good engagement conditions in relation to the electric drive. A rack is advantageously favourable in terms of a linear mounting of the actuating means. Preferably, one part of the drive region is provided with teeth in which a, for example, spur gear of an operation and/or of a gearwheel fastened to the motor shaft can engage. A rack simultaneously provides a cost-effective and structurally simple design.

In a further embodiment, the actuating means can be driven by means of a gearing. The use of a gearing, and preferably a combination of a worm gearing and one or more spur gearing stages, provides the advantage that the operation speed of the actuating means can be configured to be adjustable and, at the same time, the force available for the actuating means can be defined. In addition, one or more spur gear stages provides a cost-effective and structurally simple solution for driving an actuating means. Preferably, a worm gearing stage is positioned directly on the electric drive, on which a spur gear stage and lastly the rack drive follow. In terms of the arrangement of the components of the opening apparatus, this preferred embodiment makes it possible to configure the electric drive and the actuating means such that they can be arranged preferably at an angle of 90° to one another. This is advantageous in particular in terms of the installation situation in the body.

By way of example, the opening apparatus can be arranged in the body of the motor vehicle. In this respect, the opening device can be arranged such that a bonnet, door, flap and/or cover can be moved by means of the actuating means. For this purpose, the opening apparatus can be arranged, for example, in the body and in the font panel of the motor vehicle or in the A, B or C-pillar of the motor vehicle. If, for example, a cover for a convertible soft top is raised by means of the opening apparatus, the opening apparatus can also be positioned inside the motor vehicle. In this case, the arrangement of the actuating means on the body of the motor vehicle can be selected such that the actuating means can be adjusted out of the body of the motor vehicle. Preferably, the actuating means can be arranged flush with the body in the motor vehicle. However, it is also conceivable, for example, for a sliding member to protrude out of the body so that, when the door or flap is in the closed state, the sliding member or actuating means abuts the door or flap. The arrangement can of course be adapted depending on the structural circumstances and specific application.

Advantageously, the actuating means can be made of a plastics material at least in some regions. As already described above, making the actuating means out of a plastics material or out of a plurality of plastics materials as a single-piece or multi-piece part makes it possible to adapt the actuating means to the different requirements. A damping property of a plastics material is advantageous in the contact region, whilst a guidance property of a plastics material may be advantageous in the region of the contact with the sensor. In the region of the drive, a high hardness or strength of a plastics material is advantageous to enable a long service life of the actuating means. By means of the design according to the invention, therefore, a reliable, fatigue-endurable and structurally advantageous actuating means, and thus an opening apparatus, can be provided.

In the following, the invention will be explained in more detail with reference to the accompanying drawings on the basis of a preferred exemplary embodiment. However, the principle applies whereby the exemplary embodiment does not limit the invention but rather merely illustrates one embodiment. The features shown can be implemented either alone or in combination with further features from the description and the claims, either alone or in combination. In the drawings:

DETAILED DESCRIPTION

Figure 1:
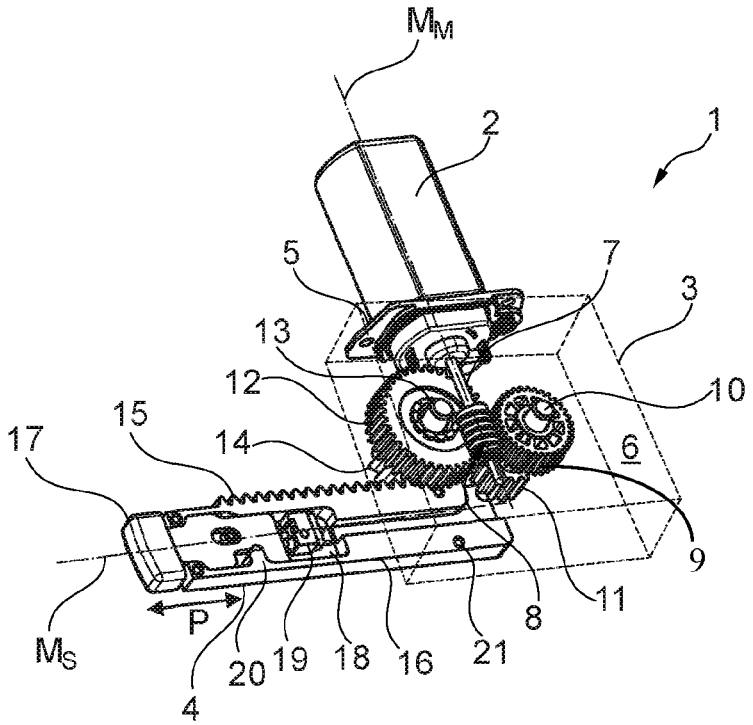
FIG. 1 is a three-dimensional view of an opening apparatus configured according to the invention, the opening apparatus being shown in part without a housing and separately from the motor vehicle.

FIG. 1 is a three-dimensional view of an opening apparatus 1, shown separately from the motor vehicle. The opening apparatus has a drive 2, a gearing 3 and an actuating means 4. In this exemplary embodiment, the electric drive 2 and the actuating means 4 are arranged substantially at right angles to one another in relation to the central axes $M_M$ and $M_S$.

The electric drive 2 is preferably a DC motor that can be fastened to a body of the motor vehicle by means of an accommodation flange 5, by which, for example, a gearing housing 6 can also be connected to the electric drive 2. Both the electric drive and the gearing 3 are fastened immovably in a motor vehicle body (not shown).

The gearing stage 3 is configured as a three-stage gearing 3 in the exemplary embodiment shown. A worm 8 is arranged on an output shaft 7 of the electric drive 2 and engages in a worm gear 9 mounted in the gearing housing 6. The worm gear 9 is connected to a pinion 11 in a rotatably fixed manner by means of a first spindle 10. The pinion 11 in turn meshes with a gearwheel 12 and thus forms the second gearing stage. In turn, a pinion 14 is arranged on a second spindle 13 and engages in teeth of the actuating means 4, said teeth being designed as a rack 15. The pinion 14 and the rack 15 thus form the third gearing stage.

The gearing stage 3 is configured as a three-stage gearing 3 in the exemplary embodiment shown. A worm 8 is arranged on an output shaft 7 of the electric drive 2 and engages in a worm wheel 9 mounted in the gearing housing 6. The worm wheel 9 is connected to a pinion 11 in a rotatably fixed manner by means of a first spindle 10. The pinion 11 in turn meshes with a gearwheel 12 and thus forms the second gearing stage. In turn, a pinion 14 is arranged on a second spindle 13 and engages in teeth of the actuating means 4, said teeth being designed as a rack 15. The pinion 14 and the rack 15 thus form the third gearing stage In this exemplary embodiment, the actuating means is constructed substantially in two parts and comprises a drive region 16 and a sliding member 17. The sliding member 17 is accommodated so as to be displaceable in the actuating means 4 in the direction of the arrow P. The sliding member 17 is thus linearly displaceable along the central axis MS of the actuating means 4. The actuating means 4 has a recess 18, which has a plurality of functions. Firstly, the recess 18 is used to integrate the sliding member 17 and a switching member 19, and at the same time it is used as a cable guide for contacting the microswitch 19. Simultaneously, the recess 18 is used as a stop 20 for the sliding member 17. By means of a cover (not shown), the sliding member 17 and the switching means 19 can be protected against moisture, in which case screw connections 21 can be used to fasten the cover.

Figure 2:
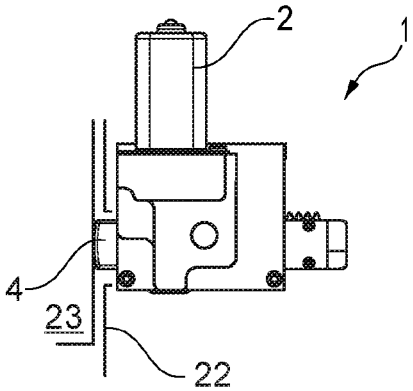
FIG. 2 is a side view of an opening apparatus according to FIG. 1 equipped with a gearing housing, in an initial or starting position.
Figure 3:
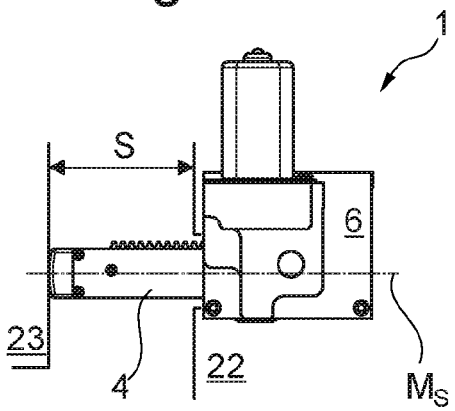
FIG. 3 is a side view of an opening apparatus according to FIG. 2 with the actuating means in a moved-out position.

FIGS. 2 and 3 now illustrate the functioning of the opening device 1 by way of example. In FIG. 1, the opening apparatus 1 is in a starting or initial position. The actuating means 4 is positioned substantially flush with a body 22 of the motor vehicle. The actuating means 4 is thus in a starting or initial position. The closure system is locked and/or latched, and a motor vehicle door 23 is in its closed position. If the motor vehicle latch is now unlatched and thus opened, by means of a sensor and preferably electrically, the drive 2 simultaneously receives a control signal so that the gearing is initiated and the actuating means can be moved out of the starting or initial position.

FIG. 3 shows the position in which the actuating means 4 has been entirely moved out of the gearing housing 6 or out of the body 22. As can be clearly seen, during the movement the actuating means 4 performs a linear movement along the central axis MRSR of the actuating means 4. As a result of the movement of the actuating means 4, the motor vehicle door 23 is moved such as to produce a gap S, into which the operator can, for example, manually reach in order to completely open the motor vehicle door. The movement of the actuating means 4 or the gap dimension S to be achieved is dependent on the length and the stroke of the actuating means 4 and can vary according to the embodiment. Preferably, actuating movements of 20-150 mm, even more preferably of 40-90 mm, and most preferably of approximately 70 mm, are carried out.

At the beginning of the actuating movement of the actuating means, the sliding member is in contact with the motor vehicle door and is moved into the drive region 16 in the direction of the arrow P. This movement can act counter to a compression spring, for example, and simultaneously causes the switching means 19 to be operated. As long as the sliding member 17 is in contact with the motor vehicle door 23, the switching means 19 remains closed. If, for example, the motor vehicle door 23 is opened further by an operator, the sliding member 17 is moved out of the drive region 16 of the actuating means, for example by a compression spring, and a signal can in turn be generated, which can be analyzed as to whether the electric drive 2 can be switched off. It goes without saying that the spring of the switching means can also be used for counterforce for the sliding member 17.

Advantageously, alternative bearings for the actuating means 4 or a linear sliding bearing for the sliding member 17 can of course also be used. By means of the opening apparatus according to the invention, it is now possible to detect a continuous detection of the actuating movement so that economical operation of the actuating means can be made possible.

LIST OF REFERENCE SIGNS

1 Opening apparatus
2 Drive
3 Gearing
4 Actuating means
5 Accommodation flange
6 Gearing housing
7 Drive shaft
8 Worm
9 worm wheel
10 First spindle
11, 14 Pinions
12 Gearwheel
13 Second spindle
15 Rack
16 Drive region
17 Sliding member
18 Recess
19 Switching means
20 Stop
21 Screw connection
22 Body
23 Motor vehicle door
$M_S$ Actuating means central axis
$M_M$ Drive central axis
P Arrow
S Gap

The invention claimed is:

1. An opening apparatus for a motor vehicle door, the opening apparatus comprising:

an electric drive;

an actuator configured to be adjusted by the electric drive, wherein the actuator is configured to engage the motor vehicle door and the motor vehicle door being configured to be opened by the actuator, and at least one sensor for detecting actuating movement (S), wherein the at least one sensor is configured to provide continuous detection of the actuating movement (S), wherein the at least one sensor is further configured to detect engagement of the actuator with the motor vehicle door and to halt actuating movement (S) when the actuator is no longer in contact with the motor vehicle door;

wherein the actuator is constructed in at least two parts and has a drive region and a sliding member, wherein the sliding member is spring biased to extend out from the drive region;

wherein the sensor is retained in the drive region, wherein the sensor comprises a switching member, wherein the sliding member is configured to close the switching member when the sliding member is in engagement with the motor vehicle door, wherein the sliding member is further configured to move out of engagement with the switching member via the spring bias when the sliding member is not in engagement with the motor vehicle door, and wherein the engagement or disengagement of the sliding member and the switching member is used to detect engagement or disengagement of the actuator with the motor vehicle door.

2. The opening apparatus according to claim 1, wherein the sensor is integrated in the actuator.

3. The opening apparatus according to claim 1, wherein the sliding member is movably accommodated in the actuator.

4. The opening apparatus according to claim 1, wherein the sensor is operable by the sliding member.

5. The opening apparatus according to claim 1, wherein the actuator is configured as a rack at least in the drive region.

6. The opening apparatus according to claim 1, wherein the actuator is made of plastics material at least in some regions.

7. The opening apparatus according to claim 1, wherein the actuator is driven by a gearing.

8. The opening apparatus according to claim 7, wherein the gearing is configured a three-stage gearing.

9. The opening apparatus according to claim 8, wherein the gearing includes a first gearing stage including a worm arranged on an output shaft of the electric drive and a worm wheel that is engageable with the worm.

10. The opening apparatus according to claim 9, wherein the gearing includes a second gearing stage including a pinion that is connected to the worm wheel in a rotatably fixed manner by a first spindle, the pinion being meshingly engageable with a gearwheel.

11. The opening apparatus according to claim 10, wherein the gearing includes a third gearing stage including a pinion arranged on a second spindle and engageable with teeth of the actuator.

12. The opening apparatus according to claim 11, wherein the teeth form an axially extending rack on the actuator.

13. The opening apparatus according to claim 1, wherein the opening apparatus is arranged in a body of the motor vehicle.

14. The opening apparatus according to claim 13, wherein the actuator is extensible out of the body of the motor vehicle.

15. The opening apparatus according to claim 13, wherein the actuator is flush with the body of the motor vehicle.

16. The opening apparatus according to claim 1, wherein the sliding member is linearly displaceable.

17. The opening apparatus according to claim 16, wherein the sliding member is linearly displaceable along a central axis of the actuator.

18. The opening apparatus according to claim 1, wherein the actuator has a recess configured to receive the sliding member and including a stop for the sliding member.

19. The opening apparatus according to claim 18, wherein the recess includes the sensor that is engageable by the sliding member.

* * * * *